US006735869B2

(12) United States Patent
Lau

(10) Patent No.: US 6,735,869 B2
(45) Date of Patent: May 18, 2004

(54) NAIL CLIPPER

(76) Inventor: Tung Yan Lau, Room 406, Wah Yiu Ind. Ctr., 30-32 Au Pui Wan St., Fotan, New Territories, Hong Kong (CH)

( * ) Notice: Subject to any disclaimer, the term of this patent is extended or adjusted under 35 U.S.C. 154(b) by 0 days.

(21) Appl. No.: 10/361,426

(22) Filed: Feb. 4, 2003

(65) Prior Publication Data

US 2003/0145467 A1 Aug. 7, 2003

(51) Int. Cl.[7] ..... A45D 29/02
(52) U.S. Cl. ..... 30/28; 30/26; 132/75.5
(58) Field of Search ..... 30/26, 28, 29, 30/124, 125; 132/73, 73.5, 75, 76.2, 75.5

(56) References Cited

U.S. PATENT DOCUMENTS

| | | | | | |
|---|---|---|---|---|---|
| 2,570,025 | A | * | 10/1951 | Davis | 30/28 |
| 2,970,376 | A | * | 2/1961 | Sheng | 30/28 |
| 3,316,632 | A | * | 5/1967 | Bowers | 30/28 |
| 3,903,596 | A | * | 9/1975 | Crosby | 30/29 |
| 5,437,679 | A | * | 8/1995 | Gaillard | 606/131 |
| 2002/0092172 | A1 | * | 7/2002 | Park | 30/28 |

* cited by examiner

*Primary Examiner*—Hwei-Siu Payer

(57) ABSTRACT

This present invention relates to a nail clipper. The nail clipper comprises a box-shaped body which has an upper cutting edge, a lower cutting part with a lower cutting edge, a spring piece, a pressing piece, a small movable piece and a cover. This invention is small in size, secure in construction and is convenient and safe to carry in the pocket.

1 Claim, 3 Drawing Sheets

NAIL CLIPPER

BACKGROUND OF THE INVENTION

The present invention pertains to a nail clipper.

A nail clipper commonly available in the marketplace (as illustrated in FIG. 5) usually comprises two steel spring pieces 1, 3, which have cutting edges, and a steel piece 2, which serves as a lever. The ends of the two steel spring pieces 1, 3, which are located away from the cutting edges 4, 5, are connected together securely. The cutting edges 4, 5 are kept away from each other in a certain distance. A hole is opened on each of the two steel spring pieces 1, 3 near the cutting edges 4, 5. A nail 6 is driven into the holes. The nail 6 has a hollow at its end. The front end of the steel piece 2 bends upward and has a hole on it, thus making the front end of the steel piece 2 forming a crossrail. The said crossrail is rotary wedged in the hollow at the end of the nail 6 which passes through the two steel spring pieces 1, 3. While in use, the steel piece 2 is rotated and the bending part of the steel piece 2 leans against the steel spring piece 3. By pressing the end of the steel piece 2 which functions as a lever, the cutting edges 4, 5 of the two steel spring pieces 1, 3 bit together to trim nails. This kind of nail clippers has open cutting edges and has one end thicker and the other end thinner. It is not convenient for storage. Further, the rotary steel piece can rotate freely and it is dangerous to put the nail clipper into the pocket.

BRIEF SUMMARY OF THE INVENTION

In view of the aforesaid disadvantages now present in the prior art, the present invention provides a new nail clipper which is secure in construction, safe, small in size and convenient to carry in the pocket.

To attain this, the present invention generally comprises a box-shaped body, which has an upper cutting edge, a lower cutting part with a lower cutting edge, a spring piece, a pressing piece, a small movable piece and a cover.

The upper cutting edge is situated at the front end of the box-shaped body.

The end of the lower cutting part is installed inside the box-shaped body, the middle of which is connected to the box-shaped body on a hinge and the head of which protrudes from the box-shaped body forming a lower cutting edge.

One end of the spring piece is fixed to the end of the box-shaped body and the other end bends upwards leaning against the end of the lower cutting part.

The front end of the pressing piece is connected to the lower cutting part and the box-shaped body on the same hinge.

One end of the small movable piece is connected to the middle front part of the pressing piece on a hinge and the other end can move freely and can connect to the end of the lower cutting part.

One end of the cover is connected to the end of the box-shaped body on a hinge and the other end can cover the top of the box-shaped body.

It is an object of the present invention to provide a new nail clipper in a box-shape with the upper cutting edge and the lower cutting edge bit together when the nail clipper is not in use.

It is another object of the present invention to provide a new nail clipper which is of secure and reliable construction and is safe to carry in the pocket.

It is a further object of the present invention to provide a new nail clipper which is uniform in thickness and small in size and is convenient to carry in the pocket.

DETAILED DESCRIPTION OF THE INVENTION

Figure 1:
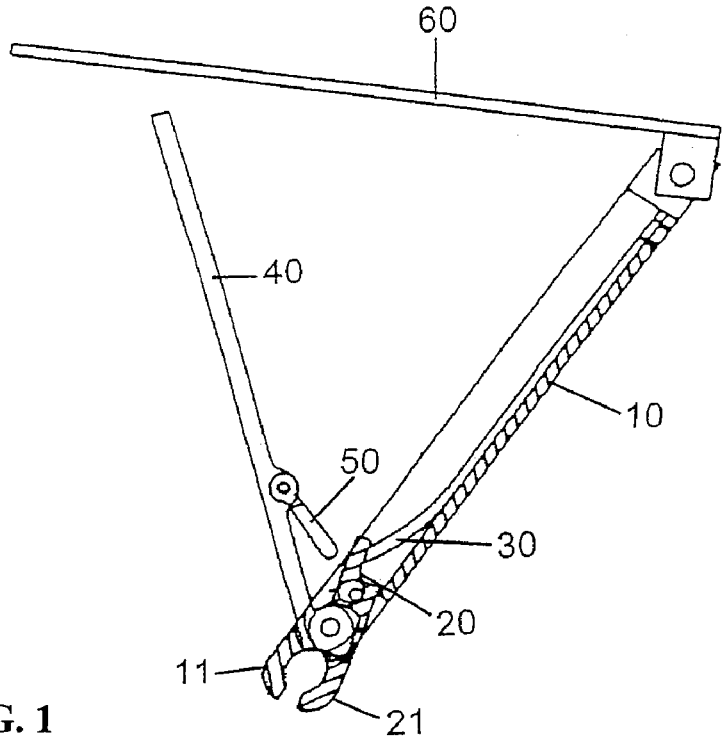
FIG. 1 shows the cross-sectional view of the nail clipper.

As illustrated in FIG. 1, the present invention generally comprises a box-shaped body 10, which has an upper cutting edge 11, a lower cutting part 20 with a lower cutting edge 21, a spring piece 30, a pressing piece 40, a small movable piece 50 and a cover 60.

The upper cutting edge 11 is situated at the front end of the box-shaped body 10. The end of the lower cutting part 20 is installed inside the box-shaped body 10, the middle of which is connected to the box-shaped body 1O on a hinge and the head of which protrudes from the box-shaped body 10 forming a lower cutting edge 21. One end of the spring piece 30 is fixed to the end of the box-shaped body 10 and the other end bends upwards leaning against the end of the lower cutting part 20. The front end of the pressing piece 40 is connected to the lower cutting part 20 and the box-shaped body 10 on the same hinge. One end of the small movable piece 50 is connected to the middle front part of the pressing piece 40 on a hinge and the other end can move freely and can connect to the end of the lower cutting part 20. One end of the cover 60 is connected to the end of the box-shaped body 10 on a hinge and the other end can cover the top of the box-shaped body 10.

Figure 2:
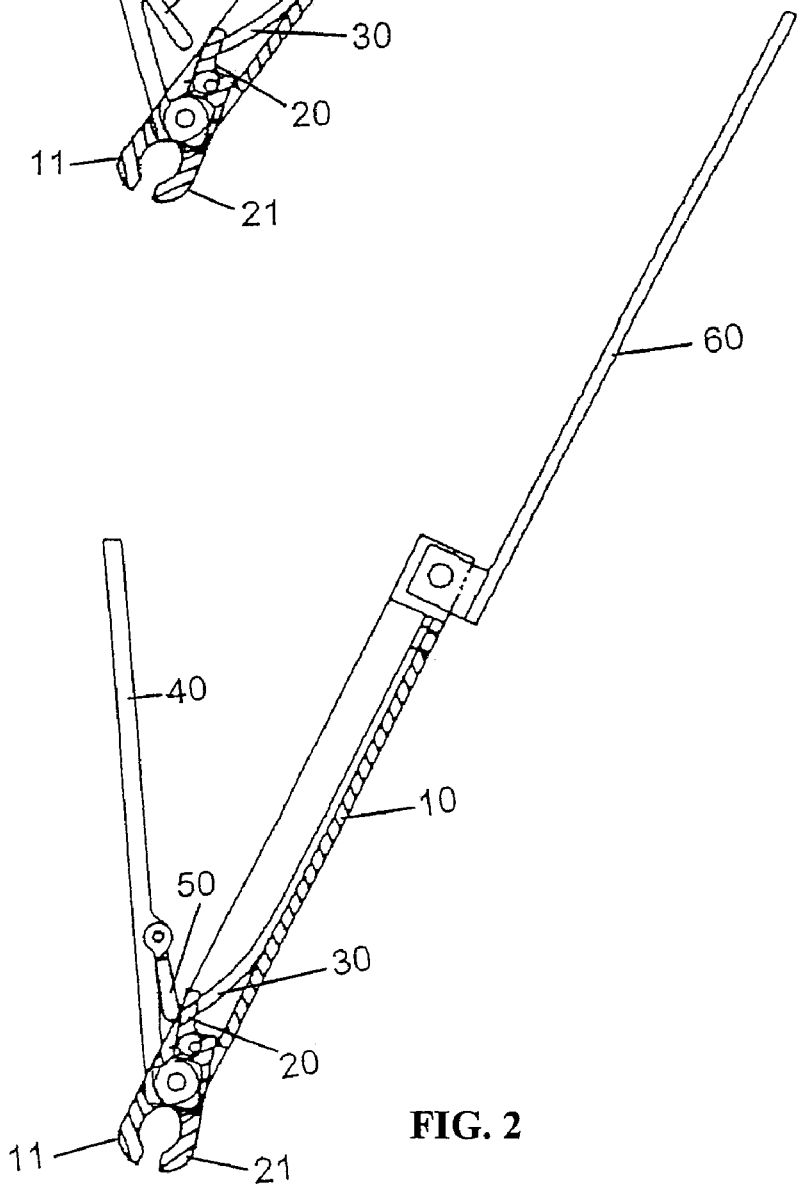
FIG. 2 shows the cross-sectional view of the nail clipper when in use.

As illustrated in FIG. 2, the cover 6 can be pulled out and the pressing piece 40 will spring out automatically. The small movable piece 50 will lean against the end of the lower cutting part 20. The pressing piece 40 will serve as a lever and by pressing it, the small movable piece 50 will press the end of the end of the lower cutting part 20, causing the lower cutting edge 21 to move upwards and the lower cutting edge 21 and the upper cutting edge 11 will bite together to trim nails.

Figure 3:
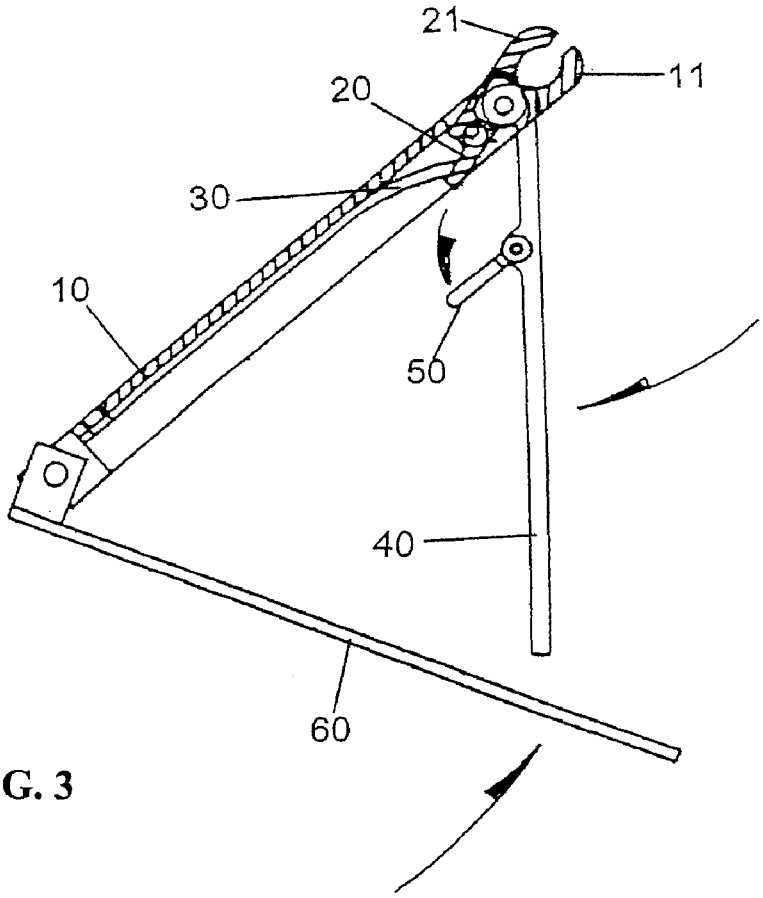
FIG. 3 shows the cross-sectional view of the nail clipper while folding.
Figure 4:
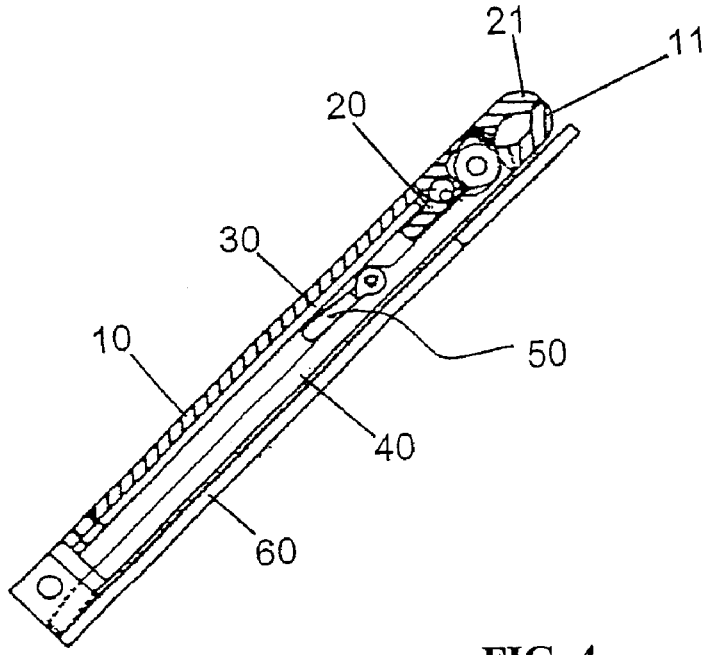
FIG. 4 shows the cross-sectional view of the nail clipper when folded for storage.
Figure 5:
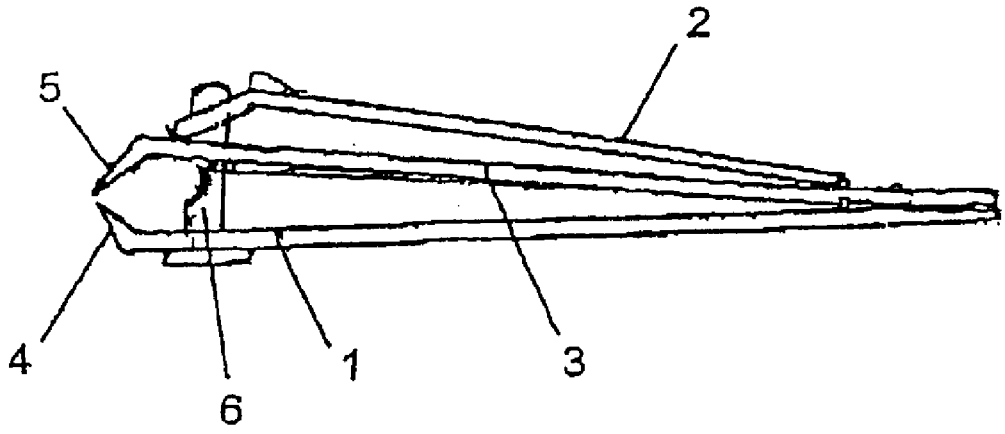
FIG. 5 PRIOR ART
FIG. 5 shows the cross-sectional view of a prior art.

As illustrated in FIGS. 3 and 4, when the present invention is folded for storage in the pocket, the small movable piece 50 can be moved away from the end of the lower cutting part 20. The pressing piece 40 is then pressed down and the cover 60 is pulled down to cover the top of the box-shaped body 10 and the lower cutting edge 21 and the upper cutting edge 11 will bite together. The present invention becomes a flat thin rectangular block.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A nail clipper comprising:

a box-shaped body which has an upper cutting edge at the front end;

a lower cutting part, the end of which is installed inside the box-shaped body, the middle of which is connected to the box-shaped body on a first hinge and the head of which protrudes from the box-shaped body forming a lower cutting edge;

a spring piece, one end of which is fixed to the end of the box-shaped body and the other end bends upwards leaning against the end of the lower cutting part;

a pressing piece, the front end of which is connected to the lower cutting part and the box-shaped body on the first hinge;

a small movable piece, one end of which is connected to the middle front part of the pressing piece on a second hinge and the other end can move freely and can connect to the end of the lower cutting part;

a cover, one end of which is connected to the end of the box-shaped body on a third hinge and the other end can cover the top of the box-shaped body.

* * * * *